US009114816B2

(12) United States Patent
Smith et al.

(10) Patent No.: US 9,114,816 B2
(45) Date of Patent: Aug. 25, 2015

(54) METHOD AND SYSTEM FOR USING LOCATION INFORMATION IN CONJUNCTION WITH RECORDED OPERATING INFORMATION FOR A RAILROAD TRAIN

(75) Inventors: Mark E. Smith, Temecula, CA (US); Brian McManus, Melbourne, FL (US); Stephen Don Smith, Satellite Beach, FL (US); Gary W. Mason, Melbourne, FL (US); Daniel Rush, Palm Bay, FL (US); Derek K. Woo, Rockledge, FL (US)

(73) Assignee: General Electric Company, Schenectady, NY (US)

( * ) Notice: Subject to any disclaimer, the term of this patent is extended or adjusted under 35 U.S.C. 154(b) by 1774 days.

(21) Appl. No.: 12/368,284

(22) Filed: Feb. 9, 2009

(65) Prior Publication Data

US 2010/0204856 A1 Aug. 12, 2010

(51) Int. Cl.

| | |
|---|---|
| ***B61L 15/00*** | (2006.01) |
| ***B61C 17/12*** | (2006.01) |
| ***B61L 25/02*** | (2006.01) |

(52) U.S. Cl.

CPC ..... *B61L 15/0027* (2013.01); *B61C 17/12* (2013.01); *B61L 25/025* (2013.01); *B61L 2205/04* (2013.01)

(58) Field of Classification Search

USPC ..... 701/19, 20, 36, 70; 246/122 R, 123, 246/167 R, 169 R, 182 R, 186

See application file for complete search history.

(56) References Cited

U.S. PATENT DOCUMENTS

| | | | | |
|---|---|---|---|---|
| 4,582,280 | A | 4/1986 | Nichols | |
| 6,044,698 | A * | 4/2000 | Bryan | 73/146 |
| 6,401,015 | B1 * | 6/2002 | Stewart et al. | 701/19 |
| 6,862,502 | B2 | 3/2005 | Peltz | |
| 7,051,044 | B1 * | 5/2006 | Fera et al. | 1/1 |

* cited by examiner

*Primary Examiner* — Mark Le

(74) *Attorney, Agent, or Firm* — GE Global Patent Operation; John Kramer

(57) ABSTRACT

A method for recording operating information of a railroad train (10) comprising a lead locomotive (14), a remote locomotive (12A), and a trailing locomotive (15). The method comprises recording the operating information of at least one of the railroad train (10) and/or a distributed power communications system onboard the railroad train (10), determining a location of the lead locomotive (14), and including the location in a record of the operating information.

8 Claims, 2 Drawing Sheets

METHOD AND SYSTEM FOR USING LOCATION INFORMATION IN CONJUNCTION WITH RECORDED OPERATING INFORMATION FOR A RAILROAD TRAIN

FIELD OF THE INVENTION

This invention relates generally to railroad train communications systems and particularly to railroad train distributed power communications systems.

BACKGROUND OF THE INVENTION

Under operator control, a railroad locomotive supplies motive power (traction) to move a train and applies brakes on the locomotive and/or on train railcars to slow or stop the train. The motive power is supplied by electric traction motors responsive to an AC or DC signal generated by the locomotive engine. The braking system comprises rail car air brakes and locomotive independent air brakes both responsive to air pressure in a brake pipe that runs a length of the train. The braking system further comprises dynamic brakes that generate slowing forces by operating the electric motors as generators, with the forces required to turn the motor/generator produced by the inertia of the train.

A train configured for distributed power (DP) operation comprises a lead locomotive at a head-end of the train and one or more of remote locomotives at an end-of-train position and/or disposed between the head-end and the end of the train. The system further comprises a distributed power train control and communications system with a communications channel (e.g., a radio frequency (RF) or a wire-based communications channel) linking the lead and remote locomotives.

The DP system generates traction and brake commands at each remote locomotive responsive to operator-initiated (i.e., the operator in the lead locomotive) control of a lead locomotive traction controller (or throttle handle) or a lead locomotive braking controller (responsive to operation of the air brake handle, dynamic brake handle, or independent brake handle). These traction or braking commands are transmitted to the remote locomotives over the DP communications channel. Each receiving remote locomotive responds to the traction or brake commands to apply or reduce tractive effort or to apply or release the brakes. Each remote locomotive further advises the lead locomotive that the command was received and executed. For example, when operating in one DP system mode (referred to as synchronous mode), the lead locomotive operator operates the lead-locomotive throttle controller to apply tractive effort of the lead locomotive according to a selected throttle notch number. The DP system issues commands to each remote locomotive to apply the same tractive effort (e.g., the same notch number). Each remote locomotive replies acknowledging execution of the command.

The lead locomotive also issues status request messages and the remote locomotives respond, for example with operational data. The lead and remote locomotives can also issue alarm messages to the other locomotives of the train.

In general, traction and braking messages sent over the distributed power communications system result in the application of more uniform tractive and braking forces to the railcars, as each locomotive can effect a brake application or release at the speed of communications channel signal rather than the slower speed of the pneumatic brake pipe pressure change that must propagate along the entire train. Distributed power train operation may therefore be preferable for long train consists to improve train handling, especially braking applications, and performance. Trains operating over mountainous terrain realize tangible benefits from DP operation.

Communications losses are particularly troublesome in a train configured for DP operation. To thoroughly analyze the communications loss it is necessary to know the location of the train when the loss occurred. For example, the communications loss may be due to a physical obstruction in the DP system communications path or due to an interfering signal in the area where the loss occurred. Although such losses are verbally reported by the crew to appropriate personnel (e.g., in a remote dispatch center), the lack of accurate location information when the loss occurred hampers determining the root cause of the problem.

The analysis of other train and locomotive problems can also be aided by location information. With information of the train/locomotive location when the problem or event occurred, a correlation between the condition of the railroad infrastructure (e.g., track, signals) and the observed problem can be determined.

BRIEF DESCRIPTION OF THE INVENTION

One embodiment of the invention comprises a method for recording operating information of a railroad train comprising a lead locomotive and a trailing locomotive. The method comprises recording the operating information of at least one of the railroad train and/or a distributed power communications system onboard the railroad train, determining a location of the lead locomotive and including the location in a record of the operating information.

The recorded operating information comprises events or operating information related to the DP system (e.g., loss of signal power, operating frequency, signal power, transmittal of DP messages, receipt of DP messages, acknowledgement of DP messages, and transmittal or receipt of DP status requests) and events or operating information related to the locomotives or railcars (e.g., loss of air brake pipe pressure, wheel bearing temperature, applied tractive effort, applied dynamic braking effort, applied air brake effort, applied independent brake effort, current notch number, and train speed).

Advantageously this embodiment of the invention solves the problems associated with determining a location of the train/locomotive when the DP communications system fails and when other train/locomotive operational anomalies occur.

BRIEF DESCRIPTION OF THE DRAWINGS

The present invention can be more easily understood and the further advantages and uses thereof more readily apparent, when considered in view of the following detailed description when read in conjunction with the following figures, wherein.

In accordance with common practice, the various described features are not drawn to scale, but are drawn to emphasize specific features relevant to the invention. Reference characters denote like elements throughout the figures and text.

DETAILED DESCRIPTION OF THE INVENTION

Figure 1:
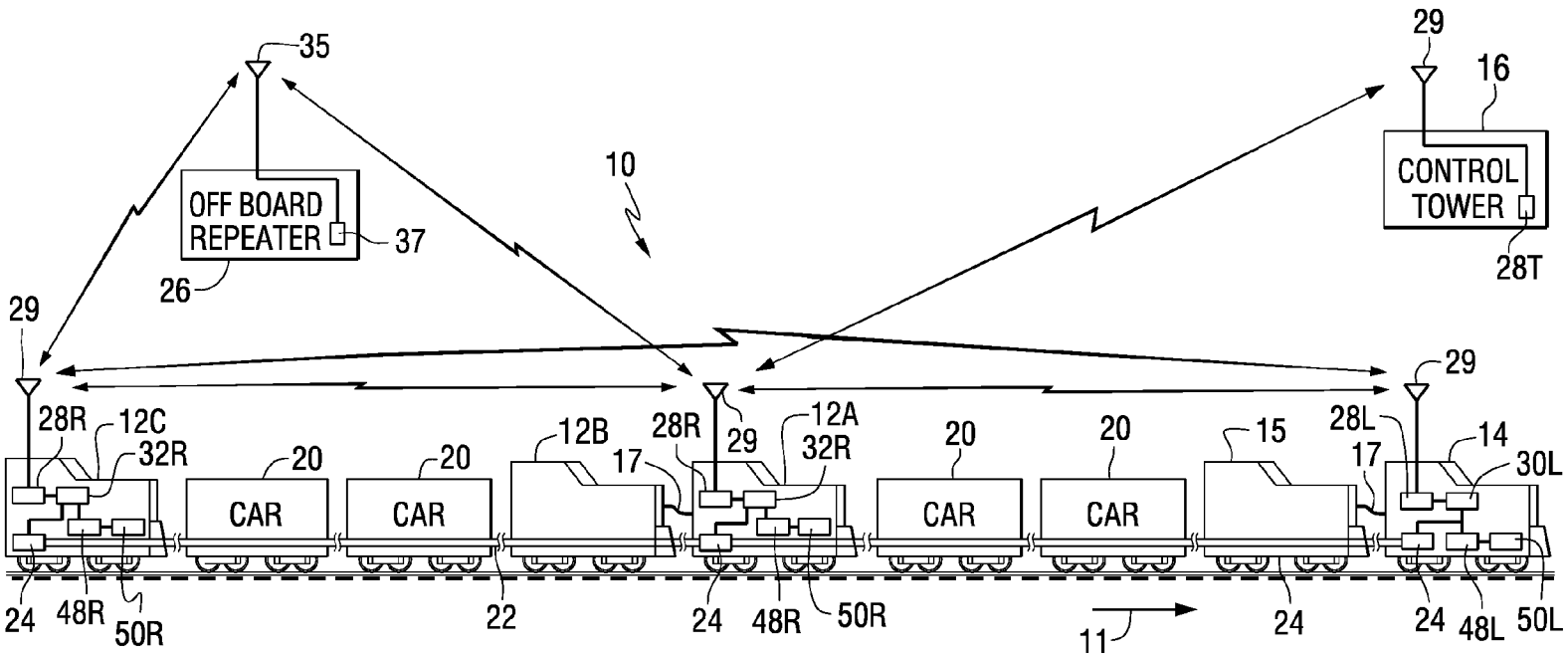
FIG. 1 illustrates a distributed power train to which the teachings of the present invention can be applied.

Before describing in detail the particular methods and apparatuses for using location information in conjunction with recorded operating information (e.g., event recording, operating parameter recording or data logging) for a distributed power communications system in accordance with the present invention, it should be observed that the present invention resides primarily in a novel combination of hardware elements related to the claimed methods and apparatuses. Accordingly, the hardware and software elements have been represented by conventional elements in the drawings, showing only those specific details that are pertinent to the present invention, so as not to obscure the disclosure with structural details that will be readily apparent to those skilled in the art having the benefit of the description herein.

The following embodiments are not intended to define limits as to the structures or methods of the invention, but only to provide exemplary constructions. The embodiments are permissive rather than mandatory and illustrative rather than exhaustive.

One example of a distributed power train control and communications systems is the LOCOTROL® distributed power communications system available from the General Electric Company of Fairfield, Conn. The LOCOTROL® distributed power system comprises a radio frequency link (channel) and receiving and transmitting equipment at the lead and the remote locomotives.

FIG. 1 schematically illustrates an exemplary distributed power train 10, traveling in a direction indicated by an arrowhead 11. Remote locomotives 12A and 12C (also referred to as remote units) are controlled by messages transmitted from either a lead locomotive 14 (also referred to as a lead unit) or from a control tower 16. Control tower commands are issued by a train dispatcher either directly to the remote locomotives 12A and 12C or to the remote locomotives 12A and 12C via the lead locomotive 14.

A trailing locomotive 15 coupled to the lead locomotive 14 is controlled by the lead locomotive 14 via control signals carried on an MU (multiple locomotive) line 17 connecting the two units. Also, a trailing remote locomotive 12B coupled to the remote locomotive 12A is controlled from the remote locomotive 12A via control signals carried on the MU line 17 connecting the two units.

Each of the locomotives 14, 12A and 12C and the control tower 16 comprises a DP transceiver 28 (also referred to as a DP radio) and a DP antenna 29 for receiving and transmitting the DP commands and messages. The DP transceivers are referred to by suffixed reference numerals 28L, 28R and 28T indicating location in the lead locomotive, one of the remote locomotives, and the control tower, respectively.

The DP commands and messages are typically generated in a lead station 30L in the lead unit 14 responsive to operator control of the motive power and braking controls in the lead locomotive 14. The remote locomotives 12A and 12C each comprise a remote station 32R for processing transmissions from the lead locomotive 14 and for issuing reply messages and commands.

The distributed power train 10 further comprises a plurality of railcars 20 interposed between the locomotives illustrated in FIG. 1 and connected to a brake pipe 22. The railcars 20 are provided with an air brake system (certain components of which are not shown in FIG. 1) that applies the railcar air brakes in response to a pressure drop in the brake pipe 22 and releases the air brakes in response to a pressure increase in the brake pipe 22. The brake pipe 22 runs the length of the train for conveying the air pressure changes specified by air brake controllers 24 in the locomotives 14, 12A and 12C.

To further improve system reliability, one embodiment of a distributed power train communications system comprises an off-board repeater 26 for receiving messages sent from the lead locomotive 14 and repeating (retransmitting) the message for receiving by the remote locomotives 12A and 12C. This embodiment may be practiced along a length of track that passes through a tunnel, for example. In such an embodiment the off-board repeater 26 comprises an antenna 35 (e.g., a leaky coaxial cable mounted along the tunnel length) and a remote station 37 for receiving and retransmitting lead messages.

The DP system further comprises a recorder 48 for recording DP communications system faults, penalties (i.e., occurrence of an event on the train or the locomotive that is an exception to normal operation and may require that the train be brought to a gradual stop), communications system losses, operating logs (e.g., a snapshot of the DP communications system operating data when a specific system exception, event or operation occurs), DP communications system and train operating information and other events of interest to the railroad operator. The recorder 48 comprises an event recorder (e.g., providing a continuous log of DP communications system operating information or locomotive operating information) and/or a data logger triggered to record operating information in response to a problematic stimulus or automatically at periodic intervals (such as every hour or every four hours). The recorder 48 time stamps the collected information, that is, for each instance of collected information, a time of when the information was collected is recorded with the collected information. Time data is provided from an onboard clock, from the time signal available in a GPS system, from an externally updated clock, or the like.

As illustrated in FIG. 1, the lead locomotive comprises a recorder 48L; the remote locomotives 12A and 12C comprise a recorder 48R. Each train is required to have at least one recorder 48, but typically each locomotive of a DP train comprises a recorder 48.

Figure 2:
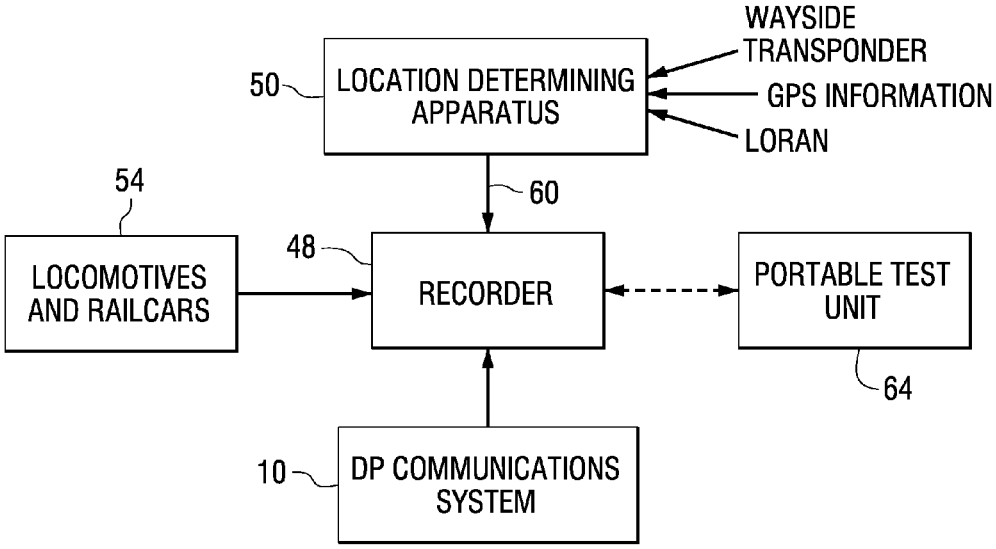
FIG. 2 illustrates, in block diagram form, elements associated with the present invention.

As illustrated in FIG. 2, the DP communications system of the present invention further comprises a location-determining apparatus 50. In one embodiment, radio signals from orbiting GPS satellites provide GPS information to the apparatus 50 from which the location of the lead locomotive 14 can be determined. The location-determining apparatus 50 in the lead locomotive 14 is referred to as apparatus 50L in FIG. 1. As further shown in FIG. 1, the remote locomotives 12A and 12C may also comprise a location-determining apparatus 50R for determining the location of each of the respective locomotives. Typically, the location of the train is defined as the location of the lead locomotive.

Onboard the lead locomotive 14 the location information is supplied by the apparatus 50L to the recorder 48L. Thus, each time an event, operating data or any operating information is recorded by the recorder 48L, the location of the lead locomotive 14, as determined by the location-determining apparatus 50L when the event occurred or when the event is recorded, is included with the event data, operating information or log data. In another application, when one or more of the recorders 48R record event data, operating information or log data associated with one of the remote locomotives, the location of the respective remote locomotive is determined and that location included with the event data, operating information or log data.

Using the location information (for example, expressed in latitude/longitude coordinates) a trained individual can determine whether there is a correlation between the occurrence of the event or log entries and the location of the train when the entry was captured. For example, if the signal power falls and this power reduction always occurs at the same location, it can be assumed that the location affects the signal power. The railroad operator can dispatch a crew to the location to determine the cause of the signal power reduction; perhaps an obstruction blocks the signal path.

The prior art requires a labor-intensive and time-sensitive manual effort, using equipment separate from the DP communications system, to collect and evaluate location information when the recorder indicates a communications system failure or another anomalous event. Typically, this prior art effort involves portable test equipment and requires running the train along the problematic stretch of track to determine if the fault can be repeated. If the fault occurs again, it is necessary to match event recorder information, operator information (e.g., tracking/braking commands) and location information (as determined by the portable equipment) to attempt to time-align or location-align the events. Clearly this is an arduous and time-consuming task. Furthermore, the fault may not be repeatable each time the same section of track is traversed.

In addition to the embodiments described above, certain operational details of the DP system can be modified based on the location of the train. For example, it is known that when the DP communications system is operating at full power (30 watts in one embodiment) the DP system RF signals may interfere with other RF signals proximate the DP train. Therefore, regulatory agencies responsible for use of the RF spectrum may require DP operation at a lower power level, especially in heavily populated areas or large cities. The location-determining feature of the present invention can determine the location of the train (e.g., expressed in latitude/longitude coordinates) and further determine when the train has entered a restricted-power area. Responsive to such a determination, the DP system radio transmit power can be automatically reduced or an alarm can be provided to the train operator advising him to manually reduce the power level. When the train has left the restricted-power area the nominal power level can be automatically or manually restored.

Certain DP system frequencies may not be available in specific areas as the use of such frequencies may cause interference with other users. Also, within certain regions, use of certain DP frequencies may be prohibited by the regulatory agency responsible for assigning frequencies and policing frequency use. Again, the location-determining feature of the present invention can be employed to prohibit operation on predetermined frequencies when the train enters specified regions. Upon entering such an area, the DP system can be automatically or manually tuned to a different frequency.

FIG. 2 illustrates certain elements associated with embodiments of the present invention. The location-determining apparatus 50 is responsive to any of several different inputs from which the location of the train (or the location of one or more of the locomotives of the train) can be determined. In one embodiment, the inputs comprise GPS signals from which the location can be determined. The location information is input to the recorder 48 via an interface 60 comprising a serial interface, such as an RS-232 or RS 422 interface, or a parallel interface.

The recorder 48 is also responsive to the DP communications system 10 for recording events (e.g., loss of signal power or reduction of signal power below a specified threshold) and recording operating information of the DP system (e.g., operating frequency, output power, transmittal of DP messages, receipt of DP messages, acknowledgement of DP messages, transmittal and receipt of DP status requests and status replies). The events and operating information recorded by the recorder 48 is output to a portable test unit 64 (in one embodiment further comprising a software download tool) for offsite analysis.

During this analysis anomalous operating data, operating information, and events are identified and the location of the train (or the location of the locomotives of the train) determined when the information was recorded. This process permits determining whether any anomalous data or information is related to the location of the train at the time of occurrence or is independent of the location.

Numerous technical, customer and monetary benefits result directly from implementation of the present invention, including faster fault isolation, reduced manpower to detect and resolve DP communications problems, elimination of hardware failures from consideration and faster resolution of train and DP communications system problems. A relatively high correlation between occurrence of a specific anomaly or operating information and a specific track location may generally allow the railroad system operator to rule out a problem with the DP communications system. Conversely, such faults may be traced to an external environmental condition. With this knowledge, a potential off-board repeater location can be identified. The present invention can also be used as a predictive tool, e.g., predicting communications system problems when the train enters a certain area.

Since the location is recorded concurrent with recording of the information/data/event, it is not necessary to later dispatch a crew to try to replicate the problem. The railroad operator saves money by diagnosing the problem in near real time and by avoiding removal of the locomotive/train from service. Using the recorder 48, it is also not necessary for a crew of technical specialists to board the customer's train to diagnose the problem as this can be accomplished remotely by use of the portable test unit 64.

The recorder 48 may also be responsive to the locomotives 14/15/12A/12B/12C and one or more of the railcars 20 (these components of the train designated generally by a reference character 54 in FIG. 2) for recording locomotive/railcar events (e.g., loss of air brake pipe pressure or wheel bearing temperature above a predetermined value) and recording train (e.g., the locomotives and/or railcars) operating information, e.g., applied tractive effort, applied dynamic braking effort, applied air brake effort, applied independent brake effort, current notch number, speed).

Generally the events and operating information recorded by the recorder 48 encompass any operational aspects of the DP system and more generally the train, including the locomotives and the railcars. Specific events and operating data cited above serve only as examples. The present invention is not limited to the cited examples.

Although the features of the present invention have been described by reference to one or two remote DP locomotives, those skilled in the art recognize that the concepts are extendable to more than two remote DP locomotives. Further, although the present invention has been described with reference to a Global Positioning System (GPS) receiver from which location information can be deduced, other devices or systems such as differential GPS (or other satellite based positioning systems), LORAN, inertial navigation systems, wheel tachometers, and wayside transponders can be used in lieu of or in addition to GPS to provide location information.

Throughout the description of the present invention, the terms "radio link," "RF link," and "RF communications" and similar terms describe a method of communicating between two links in a network. It should be understood that the communications link between nodes (locomotives) in the system in accordance with the present invention is not limited to radio or RF systems or the like and is intended to cover all techniques by which messages may be delivered from one node to another or to plural others, including without limitation, magnetic systems, acoustic systems and optical systems. Likewise, the system of the present invention is described in connection with an embodiment in which radio (RF) links are used between nodes and in which the various components are compatible with such links; however, this description of the presently preferred embodiment is not intended to limit the invention to that particular embodiment.

While the invention has been described with reference to various embodiments, it will be understood by those skilled in the art that various changes may be made and equivalent elements may be substituted for elements thereof without departing from the scope of the present invention. The scope of the present invention further includes any combination of the elements from the various embodiments set forth herein. In addition, modifications may be made to adapt a particular situation to the teachings of the present invention without departing from its essential scope. Therefore, it is intended that the invention not be limited to the particular embodiment disclosed as the best mode contemplated for carrying out this invention, but that the invention will include all embodiments falling within the scope of the appended claims.

What is claimed is:

1. An apparatus comprising:

a recorder for creating a record of operational parameters of a distributed power (DP) communications system of a rail vehicle consist, the operational parameters representative of a loss in communication between two or more powered units of the rail vehicle consist; and a location-determining component for determining a location of at least one of the powered units when the loss in communication is identified; and an element for identifying a correlation between the loss in communication and the location of the at least one of the powered units when the loss in communication is identified at least a plurality of times.

2. The apparatus of claim 1 wherein the location-determining component is configured to determine the location responsive to at least one of GPS signals, differential GPS signals, satellite-based positioning system signals, LORAN signals, inertial navigation system signals, wheel tachometer signals, or wayside transponder signals.

3. The apparatus of claim 1 wherein the recorder is configured to create a record of the operational parameters responsive to detection of the loss in communication of the DP communications system.

4. The apparatus of claim 1 wherein the recorder is configured to create a record of the operational parameters of the rail vehicle consist continuously during operation of the rail vehicle consist.

5. The apparatus of claim 1 wherein the operational parameters indicate the loss in communication when one or more of a communications system fault or an operating penalty occurs.

6. The apparatus of claim 1 wherein the recorder is configured to time stamp the record of the operational parameters.

7. The apparatus of claim 1 wherein the element is a portable unit.

8. The apparatus of claim 1 wherein the recorder comprises at least one of a data logger or an event recorder.

* * * * *